US006296373B1

(12) United States Patent
Gál et al.

(10) Patent No.: US 6,296,373 B1
(45) Date of Patent: Oct. 2, 2001

(54) INCANDESCENT LAMP FOR USE IN A REFLECTOR

(75) Inventors: Imre Gál; Attila Gonda; Tamás Torma, all of Budapest; Miklós Valovics, Piliscsaba, all of (HU)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/458,230

(22) Filed: Dec. 9, 1999

(51) Int. Cl.[7] ..... F21K 27/00
(52) U.S. Cl. ..... 362/226; 362/548; 362/263
(58) Field of Search ..... 362/226, 263, 362/394, 548, 549, 487, 313, 440, 444, 443, 437; 313/318.11

(56) References Cited

U.S. PATENT DOCUMENTS 5,345,372 * 9/1994 Takano et al. ..... 362/394
5,957,569 * 9/1999 Helbig et al. ..... 362/263

FOREIGN PATENT DOCUMENTS

97/25733 7/1997 (WO) ..... H01J/5/60

* cited by examiner

*Primary Examiner*—Sandra O'Shea
*Assistant Examiner*—Bao Truong

(57) ABSTRACT

An incandescent lamp for use in a reflector is provided. The lamp has an envelope having a longitudinal axis, at least one filament, and electrical lead-out wires. A metal support portion receives the envelope and a sleeved metal optical disc positions the filaments with respect to the reflector in a plane perpendicular to the longitudinal axis. The incandescent lamp has a plastic base anchoring the sleeved optical disc and including the electrical lead-out wires. A locking element, which is not separately formed, is used.

8 Claims, 5 Drawing Sheets

INCANDESCENT LAMP FOR USE IN A REFLECTOR

FIELD OF THE INVENTION

This invention relates to an incandescent lamp for use in a reflector, and, more particularly, to an incandescent lamp suitable for being replaceable fixed in a focused position in a reflector of a vehicle.

BACKGROUND OF THE INVENTION

The incandescent lamps used in automotive reflectors are fixed into the envelope of reflectors as replaceable lamp assemblies in such a way that the reflector and the lamp form a closed unit in which a sealing prevents humidity or dust from penetrating into the reflector. The incandescent lamp is equipped with locking elements constituting detachable joints with the elements formed in the wall of the reflector. The envelope of the incandescent lamp is set inside the reflector, while the terminals providing connection to the electrical circuit of the automobile are set outside of the reflector. The incandescent lamp must be fixed in the reflector so that the filament of the incandescent lamp takes a precisely defined position in the reflector-envelope, otherwise the beam of rays would deviate from the applicable standards. The incandescent lamp must keep this optical position during the operation, that is impacts and vibrations of the automobile must not dislocate the lamp from its position described above. At the same time, the fixing must be detachable so that the incandescent lamp can be replaced in the event of its defect. According to the effective IEC Standard No. 60061-2, the fixing is accomplished with a springy locking element pressing the incandescent lamp into the so-called V-supports shaped in the wall of the reflector by at least 10 N force. The locking element is simultaneously wedged in an indent shaped in the wall of the reflector.

An incandescent lamp applicable in automotive reflectors is described in PCT published patent application No. WO 97/25733. This lamp has a plastic base, a metal support portion and a metal support sleeve. The lower part of the metal support portion is attached to the metal support sleeve while its upper part is fixing the envelope of the incandescent lamp. The lower part of the metal support sleeve is embedded in the plastic base and the upper part of the sleeve is equipped with optical flanges. The filament of the lamp is connected through lead-out wires to terminals which can be connected to the electrical circuit of the automobile. The incandescent lamp is fixed in the reflector by placing the lamp in the opening at the rear end of the reflector, while the optical flanges penetrate into the grooves shaped in the opening of the reflector and designed to match these optical flanges. Then the lamp is twisted around its longitudinal axis while the incandescent lamp is fixed in the reflector. Fixing is provided for by a compression spring which, in one of the embodiments, is welded to the outer wall of the metal support sleeve with one end, while the other end is resting free on the outer wall of the metal support sleeve. The middle of the compression spring constitutes a flare resting on the rim of the opening of the reflector when the lamp is twisted in the reflector.

In an other embodiment, the compression spring is designed as a flaring leafspring, but its ends are placed into the apertures between the metal support sleeve and the plastic base. The flaring portion of the leaf-spring protrudes outside of the outer wall of the metal support sleeve. When the flaring portion of the leaf-spring is compressed in the course of fixing the incandescent lamp in the reflector, the ends of the leaf-spring slide deeper into the apertures, while the flaring part abuts along the opening of the reflector as described above.

In a further configuration, the flaring leaf-spring protrudes through a breach formed in the wall of the metal support sleeve under one of the three optical flanges. The ends of the leaf-spring rest on the bumpers designed on the metal support sleeve and the plastic base so that the leaf spring is compressed between these two bumpers also designed as supports.

In all the above three cases, the compression spring is made from spring steel as a separate component, which must be bent to provide the required shape, and it reaches the final position while rubbing on the glass wall of the opening of the reflector when the lamp is fixed in the reflector. Each of the presented characteristics has some kind of disadvantage. Managing the compression spring as a separate component requires separate assembling and separate storage of components. Bending the spring steel to provide the required shape is a further process increasing the manufacturing costs. The rubbing motion in the course of fixing results in the scratching of the reflector, dislocation of its reflecting surface and consequently in the decrease of the projected light.

SUMMARY OF THE INVENTION

In an exemplary the embodiment of the first aspect of the invention, an incandescent lamp for use in a reflector is provided. The lamp comprises an envelope having a longitudinal axis, at least one filament, and electrical leadout wires, a metal support portion receiving the envelop and a sleeved optical disc formed from metal and operatively associated with the metal support portion for positioning the filaments with respect to the reflector in a plane perpendicular to the longitudinal axis. The sleeved optical disc has an opening in the mantle thereof The incandescent lamp has a plastic base anchoring the sleeved optical disc and including the electrical lead-out wires. A locking element is secured against fall-out and slipped at least partly through the opening. A spring forces the locking element to move along a path substantially perpendicular to the mantle of the sleeved optical disc in a direction away from the longitudinal axis.

There is also provided an incandescent lamp in combination with a reflector, which has a wall defining an opening. The locking element is engaged in an indent formed in the wall of the opening after the incandescent lamp is fixed in the reflector.

In an exemplary embodiment of the second aspect of the invention, an incandescent lamp for use in a reflector is provided. The incandescent lamp comprises an envelope having a longitudinal axis, at least one filament, and electrical lead-out wires. The incandescent lamp has a metal support portion receiving the envelop and a sleeved optical disc formed from metal and operatively associated with the metal support portion for positioning the filaments with respect to the reflector in a plane perpendicular to the longitudinal axis. The incandescent lamp has a plastic base anchoring the sleeved optical disc and including the electrical lead-out wires. A tongue is cut out from the mantle of the sleeved optical disc and forms one piece continuously with the material of the mantle. The tongue is bent to form a leaf-spring clamped at one end and exerting force along a path substantially perpendicular to the mantle in a direction away from the longitudinal axis. The lamp includes a locking element too, formed on the leaf-spring.

There is also provided an incandescent lamp in combination with a reflector. The reflector has a wall defining an opening. The locking element formed on the leaf-spring is engaged in an indent defined by the wall of the opening after the incandescent lamp is fixed in the reflector.

The advantage of the present invention over the prior art is that the application of a separately formed leaf-spring bent for the required shape is avoided. Bending a separate leaf-spring requires additional manufacturing process steps which are complicated and expensive. A simple flat leaf-spring or a commercially available volute spring is suitable for the construction provided. Although the second aspect of the invention relates to a construction in which a bent leaf-spring is applied, however this leaf-spring is not a separate construction element. It is rather a tongue cut out from the mantle of the sleeved optical disc forming one piece continuously with the material of the mantle. Bending the leaf-spring in this case is a step integrated in the manufacturing process of the sleeved optical disc. The need of mounting a separately bent leaf-spring to the sleeved optical disc is avoided.

DETAILED DESCRIPTION OF THE INVENTION

Figure 1:
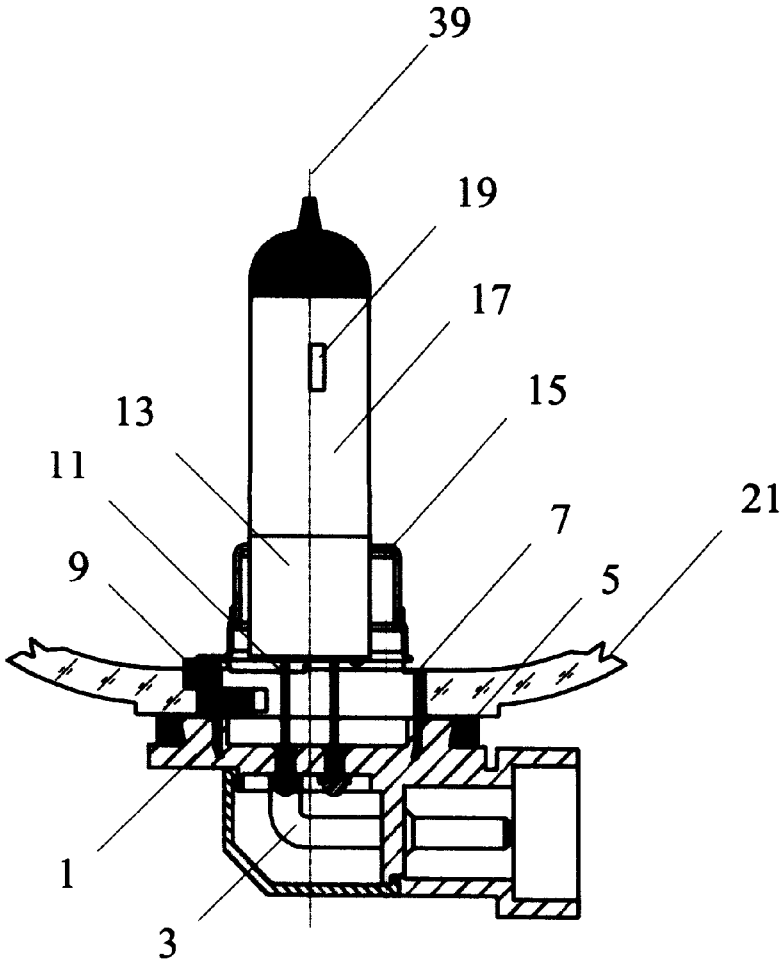
FIG. 1 is a cross-sectional view of an incandescent lamp and a part of a reflector in which the present invention embodied.
Figure 2:
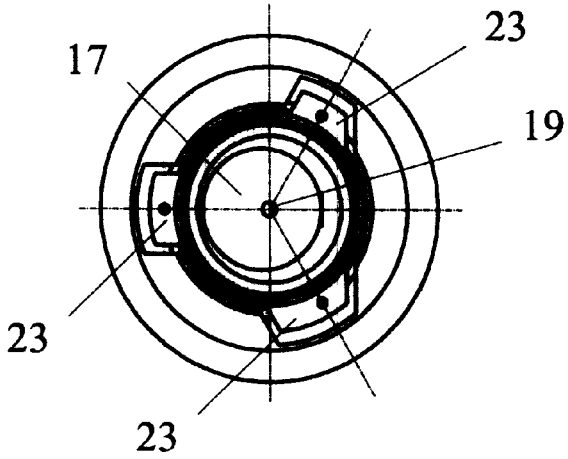
FIG. 2 is a top view of the of the incandescent lamp according to FIG. 1.

Referring now to FIGS. 1 and 2, a replaceable incandescent lamp is shown in which the present invention is embodied. The lamp is preferably a halogen incandescent lamp such as a H8, H9, H11 type or the like, which is recently used in this area of technology. The incandescent lamp has an envelope 17 with a pinched portion 13 at the one end thereof, a filament 19 and a pair of lead-out wires 11 which supply electric current to the filament 19 and are included in a plastic base 1. The other ends of the lead-out wires 11 are welded to electrical terminals 3 integrally mounted in the plastic base 1. The envelope 17 of the lamp is held firmly at its pinched portion 13 by a metal support portion 15 which is welded through an intermediary portion to a sleeved optical disc 7 made of metal and embedded in the plastic base 1. The incandescent lamp is combined with a reflector, the rear end of which is shown around the lamp. The incandescent lamp is placed in the opening of the reflector wall 21 made of glass in a fixed position.

Fixing is provided for by a locking element 9 which flexibly snaps into an appropriate indent of the reflector wall 21 thus preventing the incandescent lamp from twisting even during vibrations. The incandescent lamp is prevented from moving axially 39 by three optical flanges 23 formed on the sleeved optical disc 7 from one direction, and by a sealing 5 drawn on the plastic base 1 from the other direction. Putting the incandescent lamp into the opening of the reflector wall 21 in the right position is oriented by the three optical flanges 23 which fit into the indents formed to a similar shape in the opening of the reflector wall 21. In order to prevent false placement, each of the three 23 optical flanges has a different shape and the same applies for the indents formed in the opening of the reflector wall 21. After putting the incandescent lamp in the reflector axially 39, the lamp is twisted and fixed in the required position.

Figure 3:
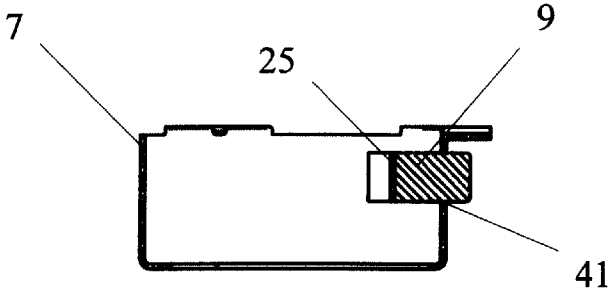
FIG. 3 is a cross-sectional view of a sleeved optical disc with a leaf-spring and stump shaped locking element taken along a plane A—A of FIG. 4.
Figure 4:
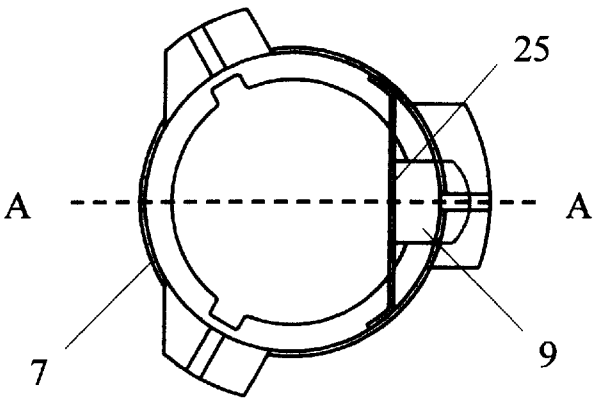
FIG. 4 shows a top view of the sleeved optical disc with the spring and locking element of FIG. 3, and indicates the plane A—A.
Figure 5:
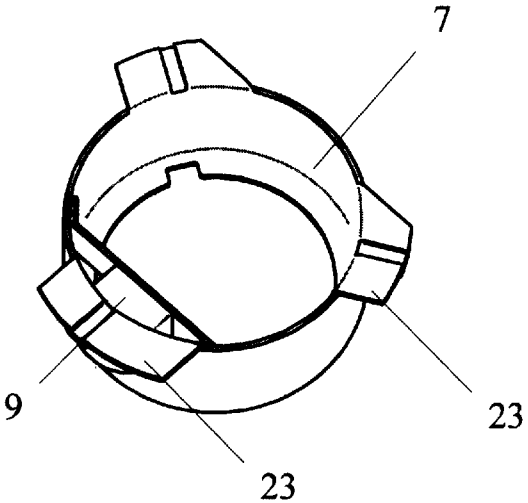
FIG. 5 is a perspective view of the sleeved optical disc shown in FIG. 3 and FIG. 4.

FIGS. 3–5 show the sleeved optical disc 7 of the incandescent lamp with a preferable design of the locking assembly. As it is shown in the figures, the sleeved optical disc 7 is substantially a cylindrical component open both on the top and at the bottom. The lower part of the sleeved optical disc 7 is embedded in the plastic base 1, while the three optical flanges 23 are formed on its upper part. The optical flanges 23 are placed in one plane which is perpendicular to the longitudinal axis of the sleeved optical disc 7. In the middle of each optical flange 23, a radial rib is formed. These ribs with their swelling sides rest upon a reference plane of the reflector wall 21 in the fixed position of the incandescent lamp. The optical flanges 23 are aligned along the upper edge of the sleeved optical disc 7 substantially in the vertices of an equilateral triangle and their shapes meet the applicable standard. In the mantle of the sleeved optical disc 7, an opening 41 is formed, through which a locking element 9 is slipped. In this embodiment, the locking element 9 is stump shaped and its end slipping through the opening 41 is rounded, while its other end is attached to the center of a straight leaf-spring 25. The two ends of the leaf-spring 25 are welded to the internal mantle of the sleeved optical disc 7. When the incandescent lamp is fixed in the reflector, the rounded external end of the locking element 9 will be engaged in the indent defined by the wall of the opening of the reflector. The radial force of the leaf-spring 25 provides fixation in t he indent mentioned above. Since the leaf-spring 25 need not be bent to a shape, its manufacturing is simple and does not requires additional, complicated and expensive process steps.

Figure 8:
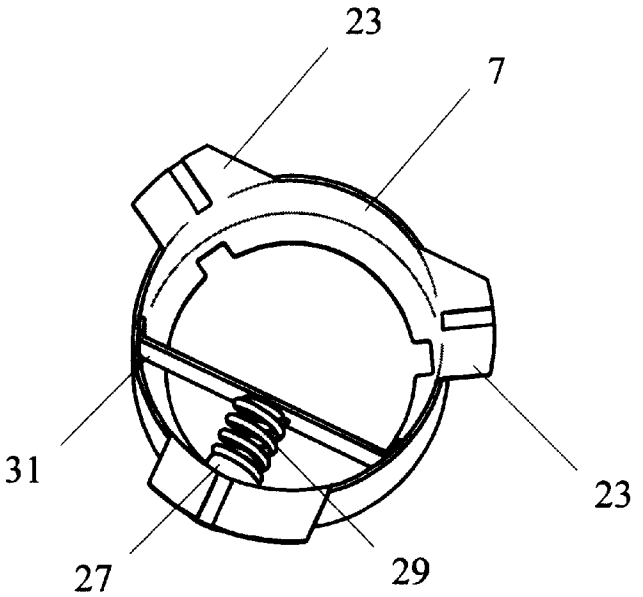
FIG. 8 is a perspective view of the sleeved optical disc shown in FIG. 6 and FIG. 7.
Figure 6:
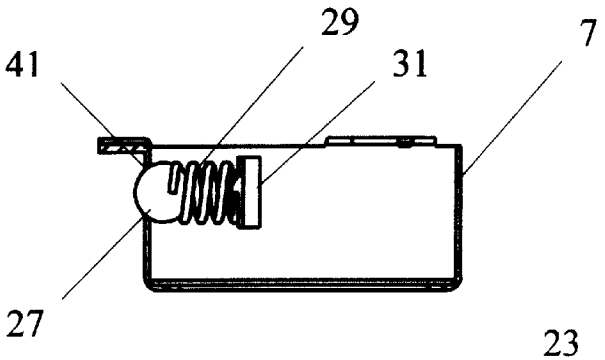
FIG. 6 is a cross-sectional view of a sleeved optical disc with volute-spring and spherical locking element taken along a plane B—B of FIG. 7.
Figure 7:
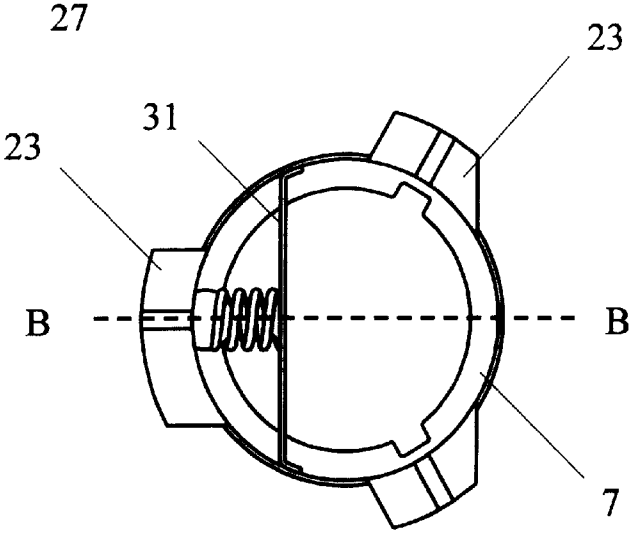
FIG. 7 shows a top view of the sleeved optical disc with the spring and locking element of FIG. 6, and indicates the plane B—B.

In the embodiment of FIGS. 6–8, the locking assembly comprises a spherical body, preferably a ball 27 and a volute spring 29, where the diameter of the ball 27 is greater than the opening 41 in the mantle of the sleeved optical disc 7. Thus the ball 27 cannot fall through the opening 41, against which the ball 27 is pressed by the volute spring 29 resting on a spring support 31. The two ends of the spring support 31 are welded to the internal surface of the mantle of the sleeved optical disc 7. Since the spring force in this case is provided by the volute spring 29, it is not necessary, just advantageous if the spring support 31 is designed as a leaf-spring described above. Since both the volute spring 29 and the ball 27 are commercially available, they can be purchased pready-made, and this simplifies the manufacturing process.

Figure 11:
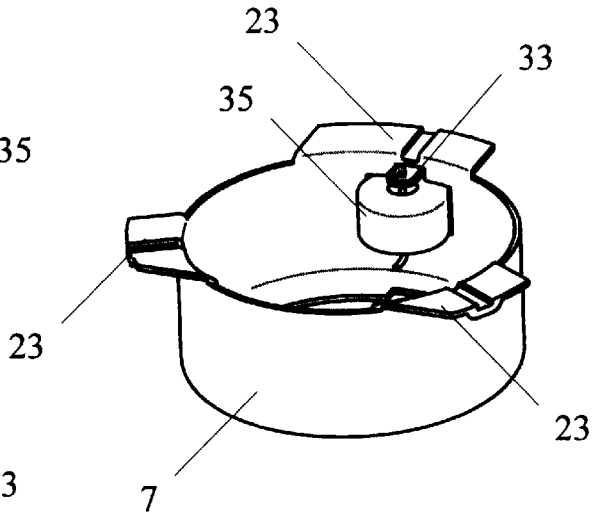
FIG. 11 is a perspective view of the sleeved optical disc shown in FIG. 9 and FIG. 10.
Figure 9:
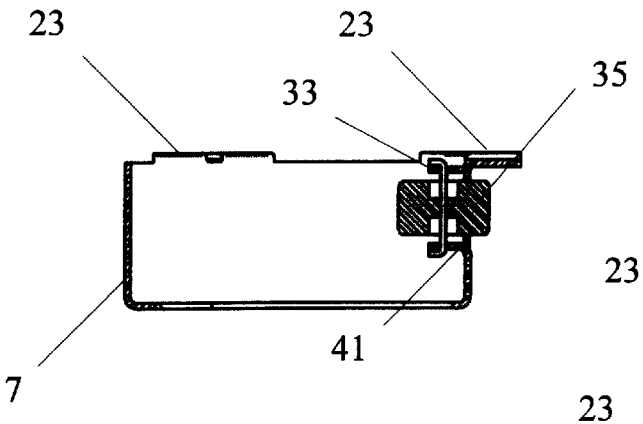
FIG. 9 is a cross-sectional view of a sleeved optical disc with a spring-shaft and a roller shaped locking element taken along a plane C—C of FIG. 10.
Figure 10:
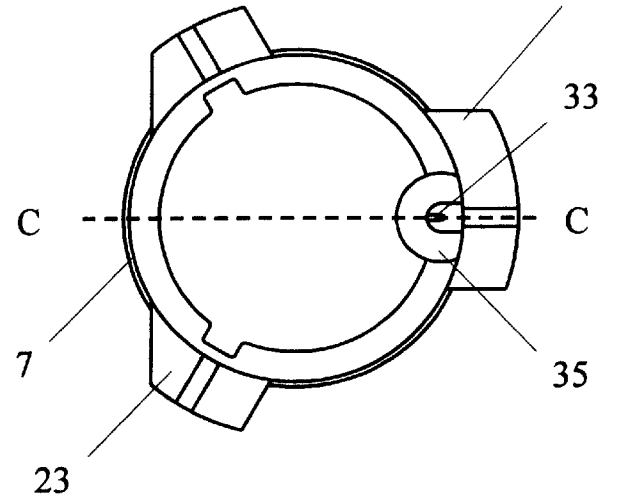
FIG. 10 shows a top view of the sleeved optical disc with the spring-shaft and the roller shaped locking element of FIG. 9, and indicates the plane C—C.

Referring now to FIGS. 9–11, the locking element is designed as a roller 35 running on a flexible shaft 33 and the two ends of the flexible shaft 33 are attached to tongues bent inwards from the mantle of the sleeved optical disc 7. A part of the roller 35 slips through an opening 41 formed in the mantle of the sleeved optical disc 7. In this embodiment of the invention, springing Of the locking element is accomplished by a flexible shaft 33. The roller 35 has two axial indents on its upper and lower side around the flexible shaft so that this shaft is in contact only with the middle portion of the roller 35. Thus the flexible shaft 33 is capable of flexible deformation which provides the radial force. When twisting the incandescent lamp, the roller 35 is rolling along the wall of the opening of the reflector until it clicks into the locking indent, so that no friction of motion, just rolling occurs on the surface of the reflector glass, which saves the surface thereof.

Figure 14:
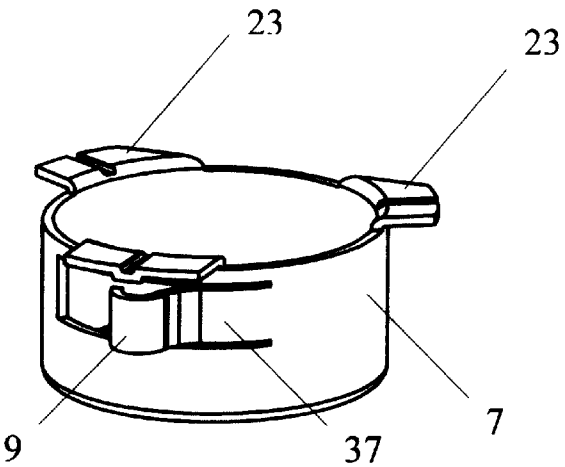
FIG. 14 is a perspective view of the sleeved optical disc shown in FIG. 12 and FIG. 13.
Figure 12:
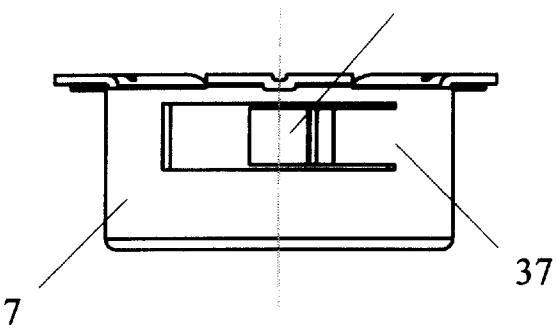
FIG. 12 is a side view of a sleeved optical disc with a bent leaf-spring cut out as a tongue from the mantle thereof.
Figure 13:
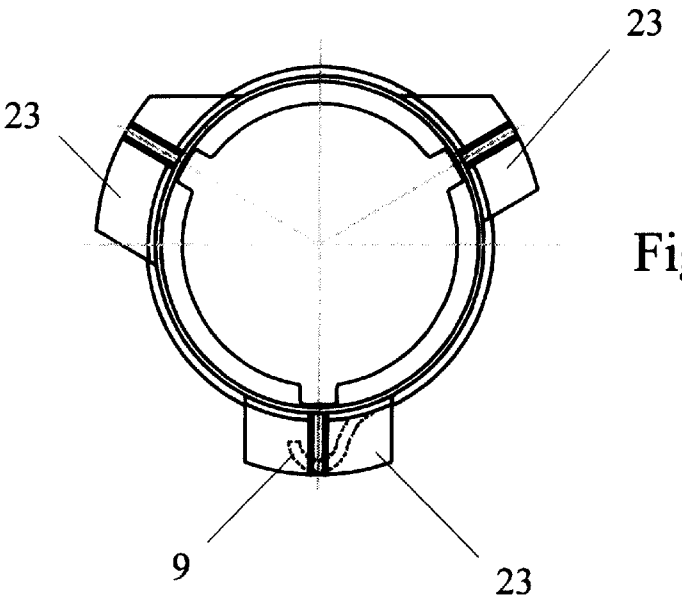
FIG. 13 is a top view of the sleeved optical disc with the tongue sh aped leaf-sprig of FIG. 12.

An embodiment representing the second aspect of the present invention is illustrated by FIGS. 12–14, where the spring and the locking element are formed from the mantle of the sleeved optical disc 7 itself. The sleeved optical disc 7 is manufactured from a pliable metal in several process steps by deep drawing, cutting and bending. The mantle, a lower shoulder and the three optical flanges 23 on the upper shoulder, together with the grooves on them are formed in the course of these steps. The spring and the locking element are also formed during these steps by cutting and bending. A tongue 37 is cut out from the mantle of the sleeved optical disc 7 which forms one piece continuously with the material of the mantle. The tongue 37 is bent to form a leaf-spring clamped at one end and exerting force along a path substantially perpendicular to the mantle in a direction away from the longitudinal axis 39. At the free end of the tongue 37, a semicircular bending constitutes the locking element 9 to be engaged in the indent of the reflector, while the necessary spring force is provided by the other part of the tongue. In this embodiment representing the best mode of carrying out the invention, no additional component is required as a leaf-spring, since the leaf-spring is provided without a separate mounting procedure in the course of bending

What is claimed is:

1. An incandescent lamp for use in a reflector comprising:

an envelope having a longitudinal axis, at least one filament, and electrical lead-out wires;

a metal support portion receiving the envelope;

a sleeved optical disc formed from metal and operatively associated with the metal support portion for positioning the filaments with respect to the reflector in a plane perpendicular to the longitudinal axis, the sleeved optical disc having an opening in the mantle thereof;

a plastic base anchoring the sleeved optical disc and including the electrical lead-out wires;

a locking element secured against fall-out and slipped at least partly through the opening; and a spring forcing the locking element to move along a path substantially perpendicular to the mantle of the sleeved optical disc in a direction away from the longitudinal axis;

wherein the locking element is a roller and is placed around a spring-shaft which is substantially parallel to the longitudinal axis and attached to the mantle of the sleeved optical disc.

2. The incandescent lamp of claim 1, in which the spring is secured to the sleeved optical disc.

3. An incandescent lamp and reflector combination comprising:

a reflector having a wall defining an opening;

an incandescent lamp including an envelope having a longitudinal axis, at least one filament, and electrical lead-out wires;

a metal support portion receiving the envelope;

a sleeved optical disc formed from metal and operatively associated with the metal support portion for positioning the filaments with respect to the reflector in a plane perpendicular to the longitudinal axis, the sleeved optical disc having an opening in the mantle thereof;

a plastic base anchoring the sleeved optical disc and including the electrical lead-out wires;

a locking element secured against fall-out and slipped at least partly through the opening;

a spring forcing the locking element to move along a path substantially perpendicular to the mantle of the sleeved optical disc in a direction away from the longitudinal axis, and the locking element being engaged in an indent formed in the wall of the opening after the incandescent lamp is fixed in the reflector.

4. The incandescent lamp of claim 3, in which the locking element has a spherical shape and is seated on one end of a volute spring; the opening is circular having a diameter smaller than the diameter of the spherical locking element; and the other end of the volute spring is seated on a spring holder.

5. The incandescent lamp of claim 3, in which the locking element has a stump shape and is secured to a straight leaf-spring are welded to the internal mantle of the sleeved optical disc.

6. An incandescent lamp for use in a reflector comprising:

an envelope having a longitudinal axis, at least one filament, and electrical lead-out wires;

a metal support portion receiving the envelope;

a sleeved optical disc formed from metal and operatively associated with the metal support portion for positioning the filaments with respect to the reflector in a plane perpendicular to the longitudinal axis;

a plastic base anchoring the sleeved optical disc and including the electrical lead-out wires;

a tongue cut out from the mantle of the sleeved optical disc and forming one piece continuously with the material of the mantle, the tongue being bent to form a leaf-spring clamped at one end and exerting force along a path substantially perpendicular to the mantle in a direction away from the longitudinal axis; and a locking element formed on the leaf-spring.

7. The incandescent lamp of claim 6, in which the other end of the leaf-spring is bent to form a locking element.

8. An incandescent lamp and reflector combination comprising:

a reflector having a wall defining an opening;

an incandescent lamp including an envelope having a longitudinal axis, at least one filament, and electrical lead-out wires;

a metal support portion receiving the envelope;

a sleeved optical disc formed from metal and operatively associated with the metal support portion for positioning the filaments with respect to the reflector in a plane perpendicular to the longitudinal axis;

a plastic base anchoring the sleeved optical disc and including the electrical lead-out wires;

a tongue cut out from the mantle of the sleeved optical disc and forming one piece continuously with the material of the mantle, the tongue being bent to form a leaf-spring clamped at one end and exerting force along a path substantially perpendicular to the mantle in a direction away from the longitudinal axis; and a locking element formed on the leaf-spring, and the locking element being engaged in an indent formed in the wall of the opening after the incandescent lamp is fixed in the reflector.

* * * * *